US012686539B1

(12) United States Patent
Yanker

(10) Patent No.: US 12,686,539 B1
(45) Date of Patent: Jul. 21, 2026

(54) BEVERAGE CONTAINER LID DEVICE

(71) Applicant: Brett Yanker, Denver, CO (US)

(72) Inventor: Brett Yanker, Denver, CO (US)

( * ) Notice: Subject to any disclaimer, the term of this patent is extended or adjusted under 35 U.S.C. 154(b) by 0 days.

(21) Appl. No.: 19/091,972

(22) Filed: Mar. 27, 2025

(51) Int. Cl.
*B65D 51/00* (2006.01)

(52) U.S. Cl.
CPC ..... *B65D 51/007* (2013.01)

(58) Field of Classification Search
CPC ..... A47G 19/2272; A47G 23/0266; B44D 3/127; B44D 3/14; B65D 1/00; B65D 1/02; B65D 1/0207; B65D 1/0215; B65D 1/0223; B65D 1/023; B65D 1/0238; B65D 1/0246; B65D 1/0253; B65D 1/0261; B65D 1/0276; B65D 1/0284; B65D 1/0292; B65D 1/04; B65D 1/06; B65D 1/09; B65D 1/10; B65D 1/12; B65D 1/14; B65D 1/16; B65D 1/165; B65D 1/20; B65D 1/22; B65D 1/225; B65D 1/24; B65D 1/243; B65D 1/246; B65D 1/26; B65D 1/265; B65D 1/28; B65D 1/32; B65D 1/323; B65D 1/34; B65D 1/36; B65D 1/40; B65D 1/42; B65D 1/44; B65D 1/46; B65D 1/48; B65D 11/00; B65D 11/02; B65D 11/04; B65D 11/06; B65D 11/08; B65D 11/10; B65D 11/12; B65D 11/16; B65D 11/18; B65D 11/1826; B65D 11/1833; B65D 11/1853; B65D 11/1866; B65D 11/20; B65D 11/22; B65D 11/26; B65D 11/28; B65D 13/00; B65D 13/02; B65D 15/00; B65D 15/02; B65D 15/04; B65D 15/06; B65D 15/08; B65D 15/10; B65D 15/14; B65D 15/18; B65D 15/22; B65D 15/24; B65D 17/00; B65D 17/02; B65D 17/04; B65D 17/06; B65D 17/08; B65D 17/12; B65D 17/14; B65D 17/28; B65D 17/30; B65D 17/32; B65D 17/34; B65D 17/347; B65D 17/353; B65D 17/36; B65D 17/40; B65D 17/401;

(Continued)

(56) References Cited

U.S. PATENT DOCUMENTS 5,547,100 A 8/1996 Johnson
6,053,347 A * 4/2000 Fullin ..... B65D 51/007 220/326

(Continued)

FOREIGN PATENT DOCUMENTS

DE 102015108403 B3 * 6/2016 ..... B65D 51/007
WO WO2004050490 6/2004
WO WO-2018162879 A1 * 9/2018 ..... B65D 51/10

*Primary Examiner* — Anthony D Stashick
*Assistant Examiner* — Marcos Javier Rodriguez Molina

(57) ABSTRACT

A beverage container lid device for inhibiting insects from entering a beverage container includes a beverage container and a container mount removably attachable to the beverage container. A pivot is coupled to and extends away from the container mount and a lock slide is coupled to and angles downwardly from the container mount. A lid is pivotally attachable to the container mount and the lid is positionable in a closed position or an open position. A locking member is slidably positioned in the lock slide. The locking member is positionable in a locking position for retaining the lid in the closed position. The locking member is slidable into an unlocking position to disengage from the lid such that the lid can be positioned in the open position.

20 Claims, 9 Drawing Sheets

(58) Field of Classification Search

CPC ..... B65D 17/4011; B65D 17/4012; B65D 17/4014; B65D 17/402; B65D 17/404; B65D 17/42; B65D 17/44; B65D 17/462; B65D 17/464; B65D 17/50; B65D 17/501; B65D 17/502; B65D 17/503; B65D 17/506; B65D 17/521; B65D 19/00; B65D 19/004; B65D 19/0059; B65D 19/0073; B65D 19/0095; B65D 19/04; B65D 19/06; B65D 19/08; B65D 19/12; B65D 19/16; B65D 19/18; B65D 19/38; B65D 19/385; B65D 19/40; B65D 19/44; B65D 21/02; B65D 21/0201; B65D 21/0202; B65D 21/0204; B65D 21/0205; B65D 21/0206; B65D 21/0208; B65D 21/0209; B65D 21/0212; B65D 21/0213; B65D 21/0215; B65D 21/0217; B65D 21/0219; B65D 21/022; B65D 21/0222; B65D 21/0223; B65D 21/0224; B65D 21/0226; B65D 21/0227; B65D 21/0228; B65D 21/023; B65D 21/0231; B65D 21/0233; B65D 21/0235; B65D 21/0237; B65D 21/0238; B65D 21/04; B65D 21/045; B65D 21/06; B65D 21/064; B65D 21/068; B65D 21/08; B65D 21/083; B65D 21/086; B65D 2201/00; B65D 2203/00; B65D 2203/02; B65D 2203/04; B65D 2203/06; B65D 2203/10; B65D 2203/12; B65D 2205/00; B65D 2205/02; B65D 2205/025; B65D 2205/04; B65D 2209/00; B65D 2213/00; B65D 2213/02; B65D 2215/00; B65D 2215/02; B65D 2215/04; B65D 2215/06; B65D 2217/00; B65D 2217/04; B65D 2221/00; B65D 2231/001; B65D 2231/007; B65D 2231/02; B65D 2231/027; B65D 2251/00; B65D 2251/0012; B65D 2251/0015; B65D 2251/0018; B65D 2251/0021; B65D 2251/0025; B65D 2251/0028; B65D 2251/0031; B65D 2251/0046; B65D 2251/0056; B65D 2251/0059; B65D 2251/0062; B65D 2251/0071; B65D 2251/0075; B65D 2251/0078; B65D 2251/0081; B65D 2251/0084; B65D 2251/0087; B65D 2251/009; B65D 2251/0093; B65D 2251/0096; B65D 2251/01; B65D 2251/02; B65D 2251/023; B65D 2251/026; B65D 2251/04; B65D 2251/06; B65D 2251/065; B65D 2251/08; B65D 2251/10; B65D 2251/1008; B65D 2251/1016; B65D 2251/1025; B65D 2251/1033; B65D 2251/1041; B65D 2251/105; B65D 2251/1058; B65D 2251/1066; B65D 2251/1075; B65D 2251/1083; B65D 2251/1091; B65D 2251/20; B65D 2251/205; B65D 2255/00; B65D 2255/20; B65D 23/00; B65D 23/001; B65D 23/003; B65D 23/005; B65D 23/02; B65D 23/04; B65D 23/08; B65D 23/0807; B65D 23/0814; B65D 23/0821; B65D 23/0828; B65D 23/0842; B65D 23/085; B65D 23/0864; B65D 23/0885; B65D 23/10; B65D 23/102; B65D 23/104; B65D 23/106; B65D 23/108; B65D 23/12; B65D 23/14; B65D 23/16; B65D 2301/20; B65D 2313/00; B65D 2313/02; B65D 2313/04; B65D 2313/06; B65D 2313/10; B65D 2401/00; B65D 2401/05; B65D 2401/10; B65D 2401/15; B65D 2401/20; B65D 2401/25; B65D 2401/30; B65D 2401/35; B65D 2401/40; B65D 2401/50; B65D 2401/55; B65D 2401/60; B65D 25/00; B65D 25/005; B65D 25/02; B65D 25/04; B65D 25/06; B65D 25/08; B65D 25/10; B65D 25/101; B65D 25/102; B65D 25/103; B65D 25/105; B65D 25/107; B65D 25/108; B65D 25/14; B65D 25/16; B65D 25/20; B65D 25/205; B65D 25/22; B65D 25/24; B65D 25/28; B65D 25/2802; B65D 25/2805; B65D 25/2808; B65D 25/2811; B65D 25/2817; B65D 25/282; B65D 25/2826; B65D 25/2835; B65D 25/2841; B65D 25/2852; B65D 25/2864; B65D 25/2867; B65D 25/2873; B65D 25/2885; B65D 25/2888; B65D 25/2894; B65D 25/2897; B65D 25/30; B65D 25/32; B65D 25/34; B65D 25/36; B65D 25/38; B65D 25/385; B65D 25/40; B65D 25/42; B65D 25/44; B65D 25/46; B65D 25/465; B65D 25/48; B65D 25/54; B65D 25/56; B65D 2501/0009; B65D 2501/0018; B65D 2501/0036; B65D 2501/0045; B65D 2501/0081; B65D 2501/009; B65D 2501/24019; B65D 2501/24082; B65D 2501/24095; B65D 2501/24108; B65D 2501/24114; B65D 2501/24127; B65D 2501/24152; B65D 2501/24184; B65D 2501/24216; B65D 2501/24229; B65D 2501/24254; B65D 2501/24324; B65D 2501/2435; B65D 2501/24522; B65D 2501/24528; B65D 2501/24541; B65D 2501/24777; B65D 2501/24802; B65D 2501/24834; B65D 2501/24847; B65D 2517/0002; B65D 2517/0004; B65D 2517/0007; B65D 2517/0008; B65D 2517/001; B65D 2517/0011; B65D 2517/0013; B65D 2517/0014; B65D 2517/0016; B65D 2517/0017; B65D 2517/0019; B65D 2517/002; B65D 2517/0022; B65D 2517/0023; B65D 2517/0025; B65D 2517/0026; B65D 2517/0028; B65D 2517/0029; B65D 2517/0031; B65D 2517/0032; B65D 2517/0034; B65D 2517/0035; B65D 2517/0038; B65D 2517/004; B65D 2517/0041; B65D 2517/0043; B65D 2517/0044; B65D 2517/0046; B65D 2517/0049; B65D 2517/005; B65D 2517/0052; B65D 2517/0053; B65D 2517/0056; B65D 2517/0059; B65D 2517/0061; B65D 2517/0062; B65D 2517/0065; B65D 2517/007; B65D 2517/0071; B65D 2517/0073; B65D 2517/0074; B65D 2517/0076; B65D 2517/0077; B65D 2517/0079; B65D 2517/008; B65D 2517/0082; B65D 2517/0083; B65D 2517/0085; B65D 2517/0086; B65D

2517/0088; B65D 2517/0089; B65D 2517/0091; B65D 2517/0092; B65D 2517/0094; B65D 2517/0097; B65D 2517/0098; B65D 2517/5005; B65D 2517/5008; B65D 2517/5013; B65D 2517/5027; B65D 2517/5029; B65D 2543/00666; B65D 2543/00675; B65D 2543/00685; B65D 2543/00694; B65D 2543/00703; B65D 2543/00712; B65D 2543/00722; B65D 2543/00731; B65D 2543/0074; B65D 2543/0075; B65D 2543/00759; B65D 2543/00768; B65D 2543/00787; B65D 2543/00796; B65D 2543/00805; B65D 2543/00814; B65D 2543/00824; B65D 2543/00833; B65D 2543/00842; B65D 2543/00851; B65D 2543/00861; B65D 2543/00879; B65D 2543/00888; B65D 2543/00898; B65D 2543/00907; B65D 2543/00925; B65D 2543/00935; B65D 2543/00944; B65D 2543/00953; B65D 2543/00962; B65D 2543/00972; B65D 2543/00981; B65D 2543/0099; B65D 2547/00; B65D 2547/04; B65D 2547/06; B65D 2547/063; B65D 2547/066; B65D 2555/02; B65D 2565/382; B65D 2565/385; B65D 2565/386; B65D 2565/387; B65D 2565/388; B65D 2571/00018; B65D 2571/00037; B65D 2571/00055; B65D 2571/00061; B65D 2571/00098; B65D 2571/00117; B65D 2571/00141; B65D 2571/00148; B65D 2571/0016; B65D 2571/00166; B65D 2571/00172; B65D 2571/00185; B65D 2571/00197; B65D 2571/00203; B65D 2571/00209; B65D 2571/00222; B65D 2571/00234; B65D 2571/00253; B65D 2571/00259; B65D 2571/00265; B65D 2571/00271; B65D 2571/00277; B65D 2571/00283; B65D 2571/0029; B65D 2571/00296; B65D 2571/00302; B65D 2571/00308; B65D 2571/00314; B65D 2571/0032; B65D 2571/00327; B65D 2571/00339; B65D 2571/0037; B65D 2571/00382; B65D 2571/00388; B65D 2571/00401; B65D 2571/00407; B65D 2571/00419; B65D 2571/00425

USPC ..... 206/0.5, 0.6, 0.7, 0.8, 0.81, 0.815, 0.82, 206/0.83, 0.84, 1.5, 1.7, 1.8, 1.9, 100, 206/110, 121, 139, 14, 145, 147, 15, 206/15.2, 15.3, 150, 158, 161, 164, 167, 206/181, 19, 194, 203, 204, 205, 207, 206/208, 209, 209.1, 210, 212, 213.1, 206/214, 215, 216, 217, 218, 219, 220, 206/221, 222, 223, 225, 227, 228, 229, 206/231, 232, 233, 234, 235, 236, 238, 206/240, 242, 244, 245, 246, 247, 249, 206/250, 251, 252, 253, 255, 256, 259, 206/260, 261, 263, 264, 265, 266, 267, 206/268, 269, 270, 271, 273, 274, 277, 206/278, 279, 292, 3, 300, 301, 303, 305, 206/306, 307, 307.1, 308.1, 308.2, 308.3, 206/309, 310, 311, 312, 313, 314, 315.1, 206/315.11, 315.2, 315.3, 315.4, 315.5, 206/315.6, 315.7, 315.8, 315.9, 316.1, 206/316.2, 317, 318, 319, 320, 326, 335, 206/338, 339, 340, 349, 350, 354, 355, 206/356, 359, 361, 362, 362.1, 362.2, 206/363, 364, 365, 366, 368, 369, 37, 206/37.1, 37.4, 37.7, 370, 371, 372, 373, 206/374, 375, 378, 379, 38, 38.1, 380, 206/382, 384, 385, 386, 387.1, 387.11, 206/387.12, 387.13, 387.15, 388, 389, 39, 206/39.4, 39.7, 390, 391, 394, 395, 397, 206/404, 405, 406, 407, 408, 409, 416, 206/418, 419, 423, 424, 425, 427, 428, 206/431, 432, 433, 438, 439, 440, 443, 206/445, 446, 448, 449, 45.2, 45.21, 206/45.23, 45.24, 45.28, 45.29, 45.3, 451, 206/453, 454, 455, 456, 457, 459.1, 206/459.5, 460, 461, 462, 463, 467, 468, 206/469, 470, 471, 472, 477, 480, 483, 206/484, 484.1, 484.2, 485, 486, 488, 206/493, 494, 495, 496, 497, 499, 5, 5.1, 206/500, 501, 503, 504, 505, 506, 507, 206/508, 509, 510, 511, 512, 514, 515, 206/516, 518, 519, 520, 521, 521.1, 522, 206/523, 524.1, 524.2, 524.3, 524.4, 206/524.5, 524.6, 524.7, 524.8, 525, 526, 206/527, 528, 529, 530, 531, 532, 533, 206/534, 534.1, 534.2, 535, 536, 537, 206/538, 539, 540, 541, 542, 543, 544, 206/545, 546, 547, 548, 549, 550, 551, 206/553, 554, 555, 556, 557, 558, 560, 206/561, 562, 563, 564, 565, 566, 568, 206/569, 570, 571, 572, 573, 575, 576, 206/579, 581, 583, 585, 586, 587, 588, 206/589, 591, 592, 593, 594, 596, 597, 206/598, 599, 6.1, 600, 63.3, 63.5, 69, 206/701, 702, 703, 704, 705, 706, 707, 206/708, 709, 710, 711, 714, 718, 719, 206/720, 722, 723, 724, 725, 730, 734, 206/736, 738, 745, 747, 749, 751, 753, 206/754, 755, 756, 758, 762, 763, 767, 206/768, 77.1, 772, 775, 776, 779, 782, 206/783, 784, 8, 800, 803, 804, 806, 807, 206/810, 811, 812, 813, 814, 815, 816, 206/817, 818, 819, 820, 821, 822, 823, 206/828, 83, 83.5, 830, 831, 832, 85, 86, 206/87, 88, 90, 91, 92, 94, 96; 215/10, 215/11.1, 11.3, 11.4, 11.5, 11.6, 12.1, 215/12.2, 13.1, 16, 17, 18, 19, 2, 20, 200, 215/201, 202, 203, 204, 206, 207, 208, 215/209, 21, 210, 211, 212, 213, 214, 215/215, 216, 217, 218, 219, 22, 220, 215/221, 222, 223, 224, 225, 226, 227, 215/228, 229, 23, 230, 231, 232, 234, 215/235, 236, 237, 238, 239, 24, 240, 215/241, 243, 244, 245, 246, 247, 248, 215/249, 25, 250, 251, 252, 253, 254, 215/255, 256, 257, 258, 26, 260, 261, 215/262, 269, 27, 270, 271, 272, 273, 215/274, 275, 276, 277, 278, 279, 28, 215/280, 281, 283, 284, 285, 286, 287, 215/289, 29, 290, 291, 292, 293, 294, 215/295, 296, 297, 298, 299, 3, 30, 301, 215/302, 303, 304, 305, 306, 307, 308, 215/309, 310, 311, 312, 313, 314, 315, 215/316, 317, 318, 319, 320, 321, 322, 215/323, 324, 325, 326, 327, 328, 329,

215/330, 331, 332, 333, 334, 335, 337, 215/340, 341, 342, 343, 344, 345, 346, 215/347, 348, 349, 350, 351, 352, 353, 215/354, 355, 356, 358, 359, 360, 361, 215/363, 364, 365, 366, 370, 373, 376, 215/377, 378, 379, 381, 382, 383, 384, 215/386, 387, 388, 389, 390, 391, 392, 215/395, 396, 397, 398, 399, 4, 40, 41, 215/43, 44, 45, 46, 47, 48, 49, 5, 50, 55, 215/6, 900, 901, 902, DIG. 1, DIG. 2, 215/DIG. 3, DIG. 5, DIG. 7, DIG. 8; 220/1.5, 1.6, 2.2, 2.3 R, 200, 201, 202, 220/203.01, 203.02, 203.03, 203.04, 220/203.05, 203.06, 203.07, 203.08, 220/203.09, 203.1, 203.11, 203.12, 220/203.13, 203.16, 203.17, 203.18, 220/203.19, 203.2, 203.21, 203.22, 220/203.23, 203.24, 203.25, 203.26, 220/203.27, 203.28, 203.29, 210, 211, 220/212, 212.5, 213, 214, 215, 216, 221, 220/222, 225, 227, 228, 229, 23.2, 23.4, 220/23.6, 23.8, 23.83, 23.86, 23.87, 220/23.88, 23.89, 23.9, 23.91, 230, 231, 220/232, 233, 234, 235, 236, 237, 238, 220/239, 240, 241, 242, 243, 244, 245, 220/246, 249, 250, 251, 252, 253, 254.1, 220/254.2, 254.3, 254.4, 254.5, 254.6, 220/254.7, 254.8, 254.9, 255, 255.1, 220/256.1, 257.1, 257.2, 258.1, 258.2, 220/258.3, 258.4, 258.5, 259.1, 259.2, 220/259.3, 259.4, 259.5, 260, 261, 262, 220/263, 264, 265, 266, 267, 268, 269, 220/270, 271, 273, 274, 276, 277, 278, 220/279, 281, 282, 283, 284, 285, 287, 220/288, 290, 291, 292, 293, 294, 295, 220/296, 297, 298, 3.2, 3.3, 3.5, 3.7, 3.8, 220/300, 301, 302, 303, 304, 305, 309.1, 220/309.2, 310.1, 314, 315, 316, 318, 220/319, 320, 321, 322, 323, 324, 325, 220/326, 327, 328, 345.1, 345.2, 345.3, 220/345.4, 345.5, 345.6, 348, 349, 350, 220/351, 359.1, 359.2, 359.3, 359.4, 360, 220/361, 363, 366.1, 367.1, 369, 370, 220/371, 372, 373, 374, 375, 376, 377, 220/377.1, 378, 379, 380, 4.01, 4.02, 220/4.03, 4.12, 4.13, 4.16, 4.21, 4.22, 220/4.23, 4.24, 4.25, 4.26, 4.27, 4.28, 220/4.29, 4.31, 4.32, 4.33, 4.34, 475, 476, 220/477, 478, 480, 481, 482, 483, 484, 220/485, 486, 487, 488, 494, 495, 495.01, 220/495.02, 495.03, 495.04, 495.05, 220/495.06, 495.07, 495.08, 495.09, 220/495.1, 495.11, 500, 501, 502, 503, 220/504, 505, 506, 507, 508, 509, 512, 220/513, 515, 516, 518, 519, 520, 521, 220/522, 523, 524, 525, 526, 527, 528, 220/529, 530, 531, 532, 533, 534, 535, 220/543, 544, 546, 549, 551, 553, 554, 220/555, 556, 559, 560, 560.01, 560.03, 220/560.04, 560.05, 560.07, 560.08, 220/560.1, 560.12, 562, 564, 565, 567.1, 220/567.2, 568, 570, 571, 573, 573.1, 220/573.4, 574, 574.1, 575, 576, 577, 220/578, 580, 581, 582, 583, 586, 590, 220/592.01, 592.02, 592.03, 592.09, 220/592.1, 592.13, 592.14, 592.16, 220/592.17, 592.18, 592.19, 592.2, 220/592.21, 592.22, 592.23, 592.24, 220/592.25, 592.26, 592.27, 592.28, 6, 220/600, 601, 603, 604, 605, 606, 608, 220/609, 610, 611, 612, 613, 614, 615, 220/617, 619, 62, 62.11, 62.12, 62.15, 220/62.17, 62.18, 62.19, 62.21, 62.22, 220/620, 621, 622, 623, 624, 625, 626, 220/627, 628, 629, 630, 631, 632, 633, 220/634, 636, 639, 640, 642, 643, 645, 220/646, 648, 649, 651, 652, 656, 657, 220/658, 659, 660, 661, 662, 663, 665, 220/666, 668, 669, 671, 672, 673, 674, 220/675, 676, 678, 680, 681, 682, 683, 220/686, 689, 690, 692

See application file for complete search history.

(56) References Cited

U.S. PATENT DOCUMENTS

| | | | | |
|---|---|---|---|---|
| 6,290,084 | B1 | 9/2001 | Louie | |
| 6,722,518 | B1 | 4/2004 | Bartz | |
| 8,327,608 | B2 | 12/2012 | Ebitz | |
| 10,099,828 | B1 * | 10/2018 | Defer | B65D 51/04 |
| 2009/0032531 | A1 | 2/2009 | Navare | |
| 2014/0361029 | A1 * | 12/2014 | Robinson | B65D 51/007 53/485 |
| 2018/0134464 | A1 * | 5/2018 | Battaglia | B65D 21/0206 |
| 2019/0177052 | A1 * | 6/2019 | Battaglia | B65D 55/16 |
| 2020/0262621 | A1 * | 8/2020 | Savenok | B65D 43/0212 |

* cited by examiner

BEVERAGE CONTAINER LID DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to beverage container devices and more particularly pertains to a new beverage container device for inhibiting insects from entering a beverage container. The device includes a container mount that is attachable to beverage container and a lid that is pivotally attached to the container mount. A lock slide is attached to the container mount and a locking member is slidably positioned in the locking slide. The lid is biased into an open position and the locking member retains the lid in a closed position to inhibit insects from accessing the beverage container. The lid is biased into the open position when the locking member is urged into an unlocking position to facilitate a user to drink from the beverage container.

(2) Description of Related Art Including Information Disclosed Under 37 CFR 1.97 and 1.98

The prior art relates to beverage container devices including: a beverage can insect cover that includes a circular member that is attachable to a beverage can and a semi-circular aperture for drinking from the beverage can; a beverage container cover device that includes a circular cover and a flexible cover integrated into the circular cover to expose a drinking aperture in the beverage container; a variety of drink opening cover devices which each includes a semi-circular panel that is attachable to a pull tab of a beverage container which can be rotated to cover a drink aperture in the beverage container. In no instance does the prior art disclose a beverage container lid device that includes a container mount that is removably attachable to a beverage container and a lid that is pivotally attached the container mount which is urgeable into an open position to expose a drinking aperture in the beverage container and is biased into a closed position to cover a drinking aperture in the beverage container.

BRIEF SUMMARY OF THE INVENTION

An embodiment of the disclosure meets the needs presented above by generally comprising a beverage container and a container mount removably attachable to the beverage container. A pivot is coupled to and extends away from the container mount and a lock slide is coupled to and angles downwardly from the container mount. A lid is pivotally attachable to the container mount and the lid is positionable in a closed position or an open position. A locking member is slidably positioned in the lock slide. The locking member is positionable in a locking position for retaining the lid in the closed position. The locking member is slidable into an unlocking position to disengage from the lid such that the lid can be positioned in the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
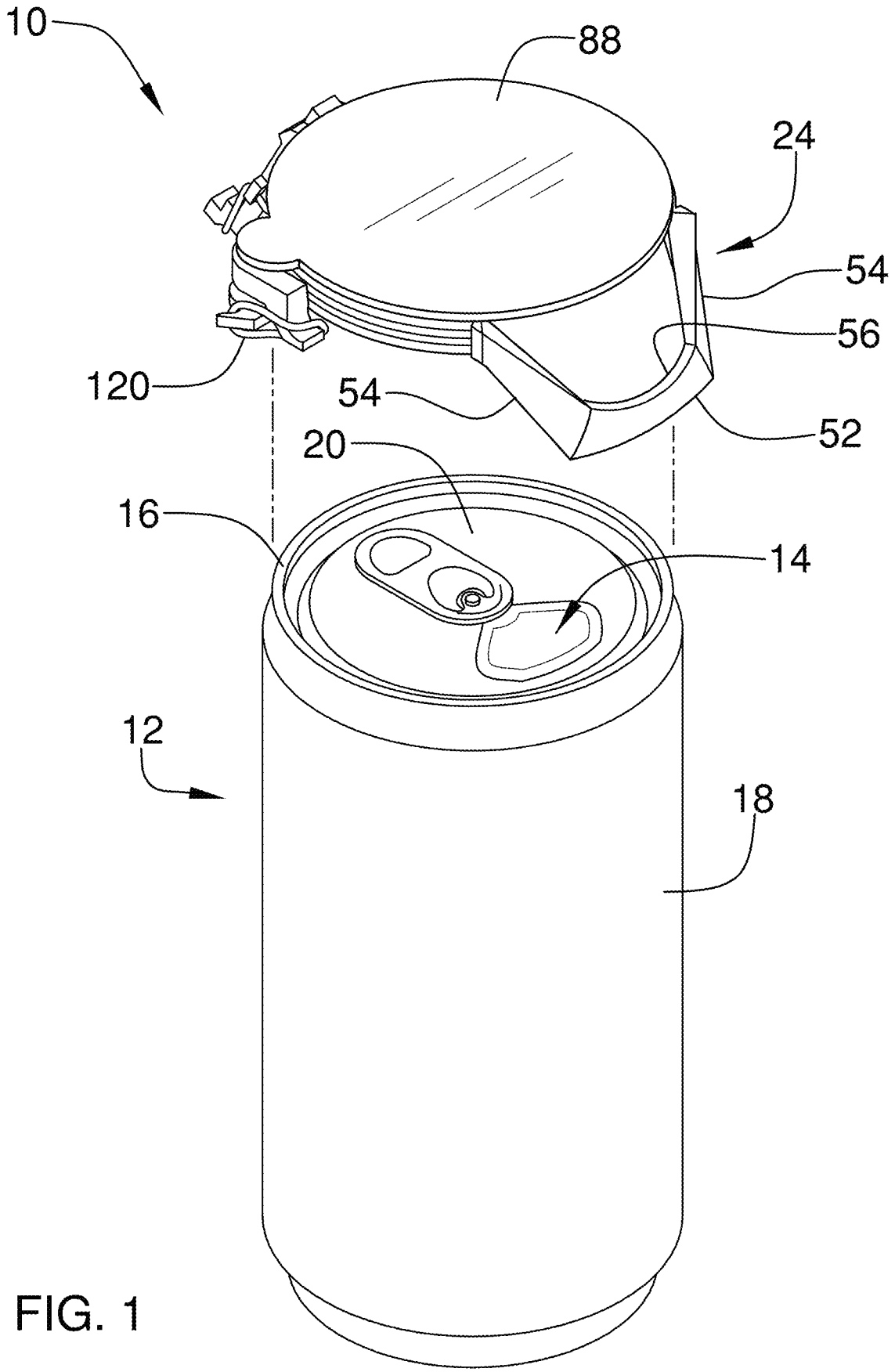
FIG. 1 is a top perspective view of a beverage container lid device according to an embodiment of the disclosure.
Figure 2:
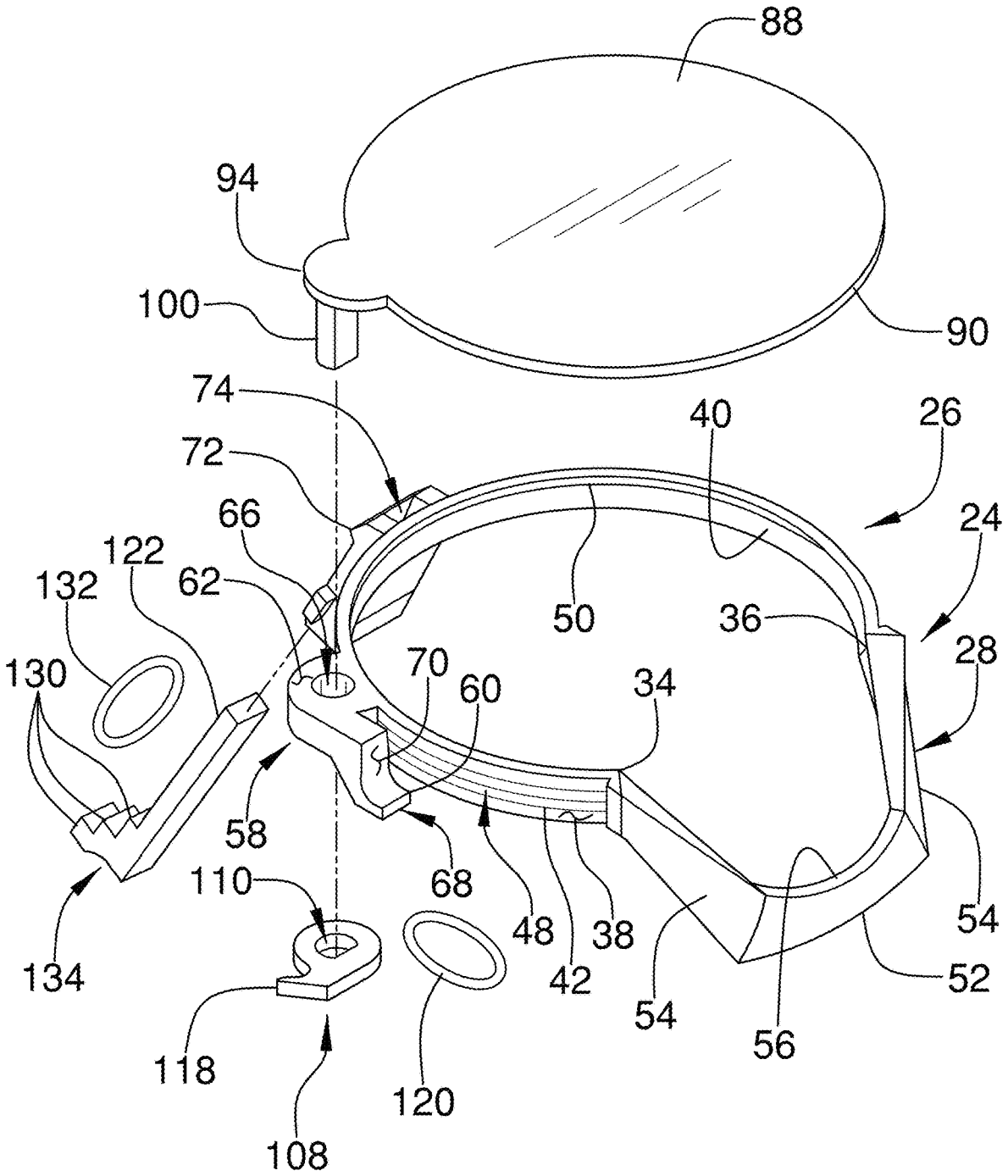
FIG. 2 is an exploded perspective view of a container mount of an embodiment of the disclosure.
Figure 3:
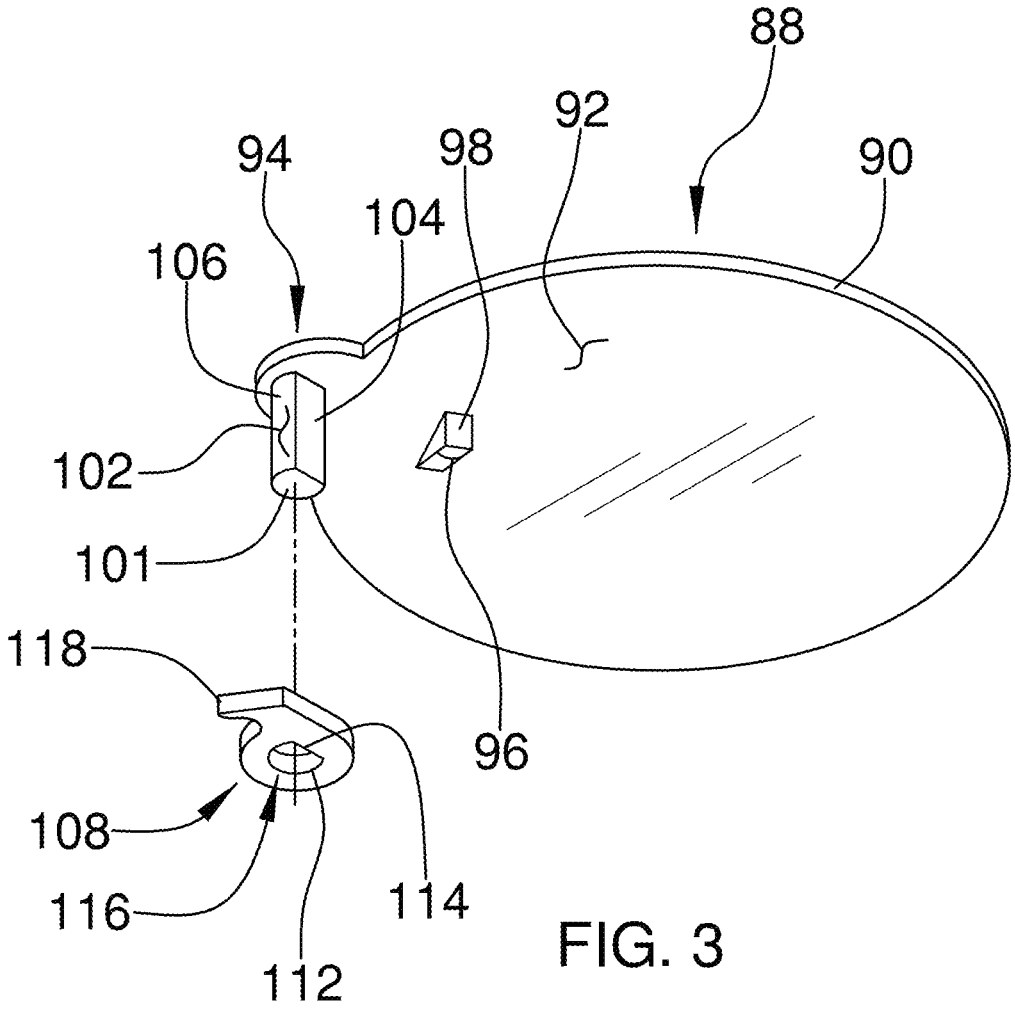
FIG. 3 is a bottom perspective view of a lid and a pivot ring of an embodiment of the disclosure.
Figure 4:
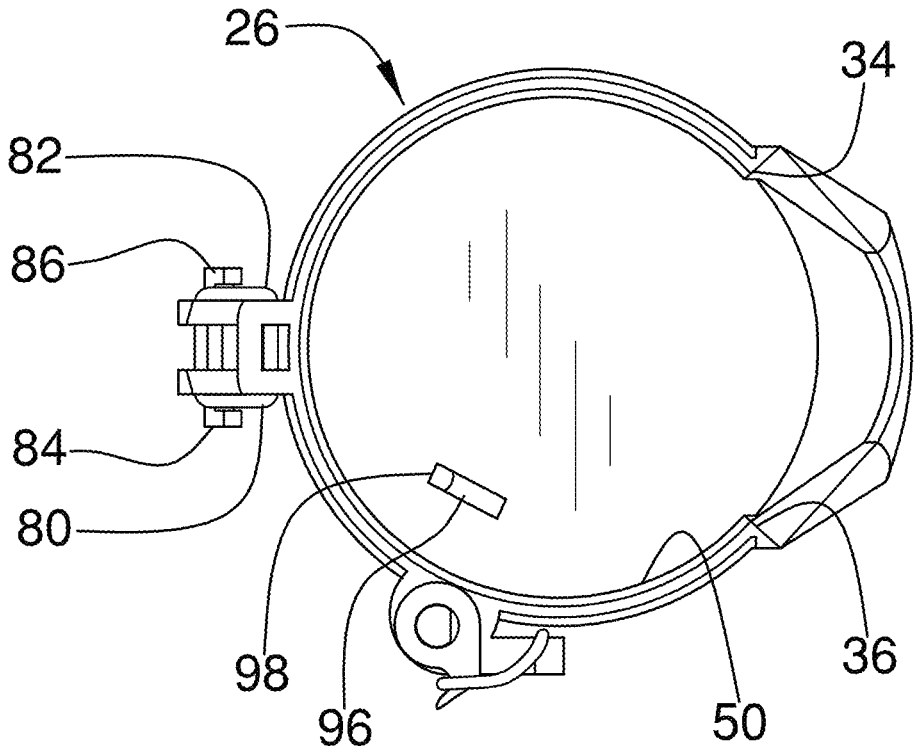
FIG. 4 is a bottom view of a container mount of an embodiment of the disclosure showing a lid in a closed position.
Figure 5:
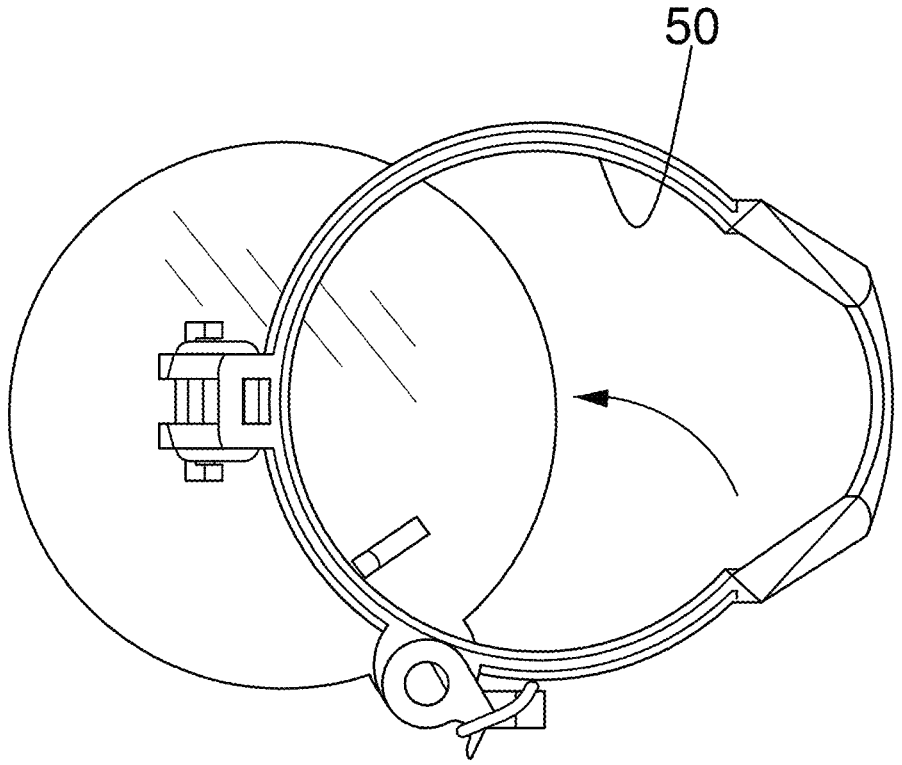
FIG. 5 is a bottom view of a container mount of an embodiment of the disclosure showing a lid in an open position.
Figure 6:
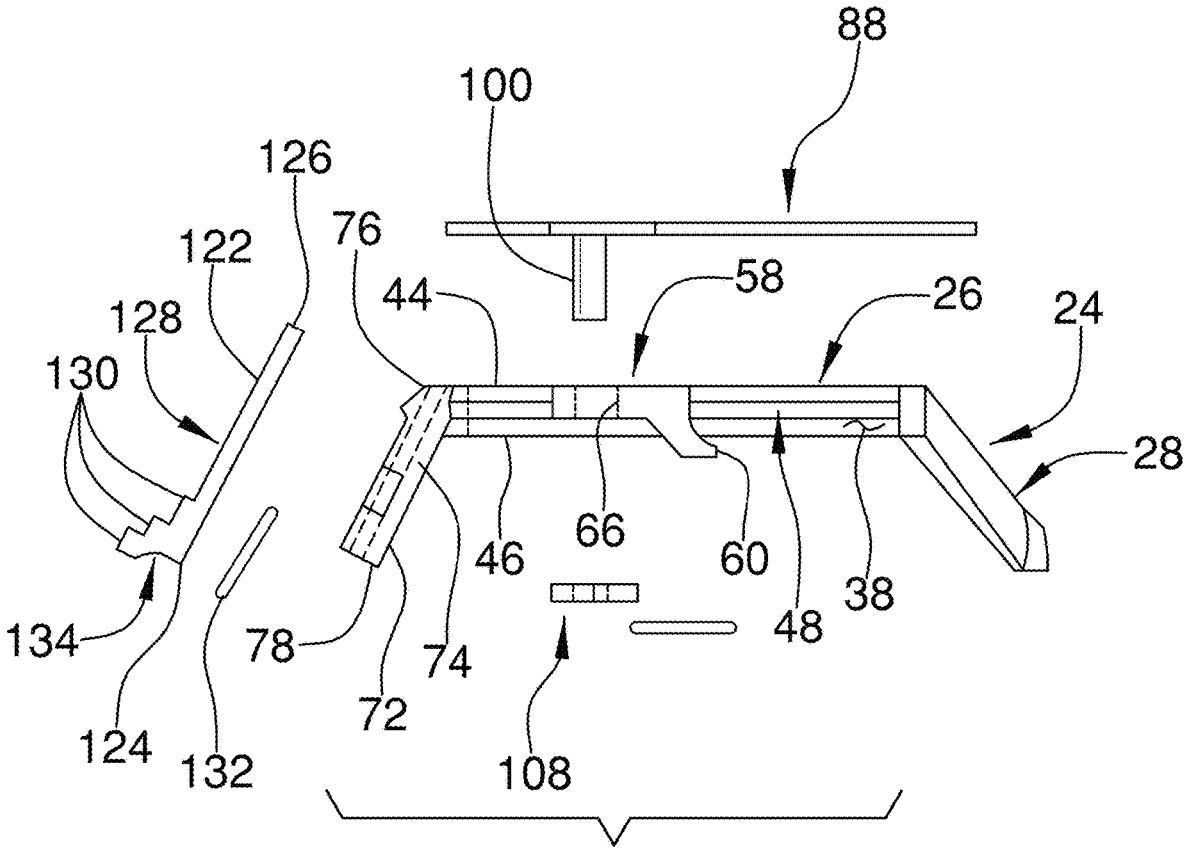
FIG. 6 is a right side exploded view of a container mount of an embodiment of the disclosure.
Figure 7:
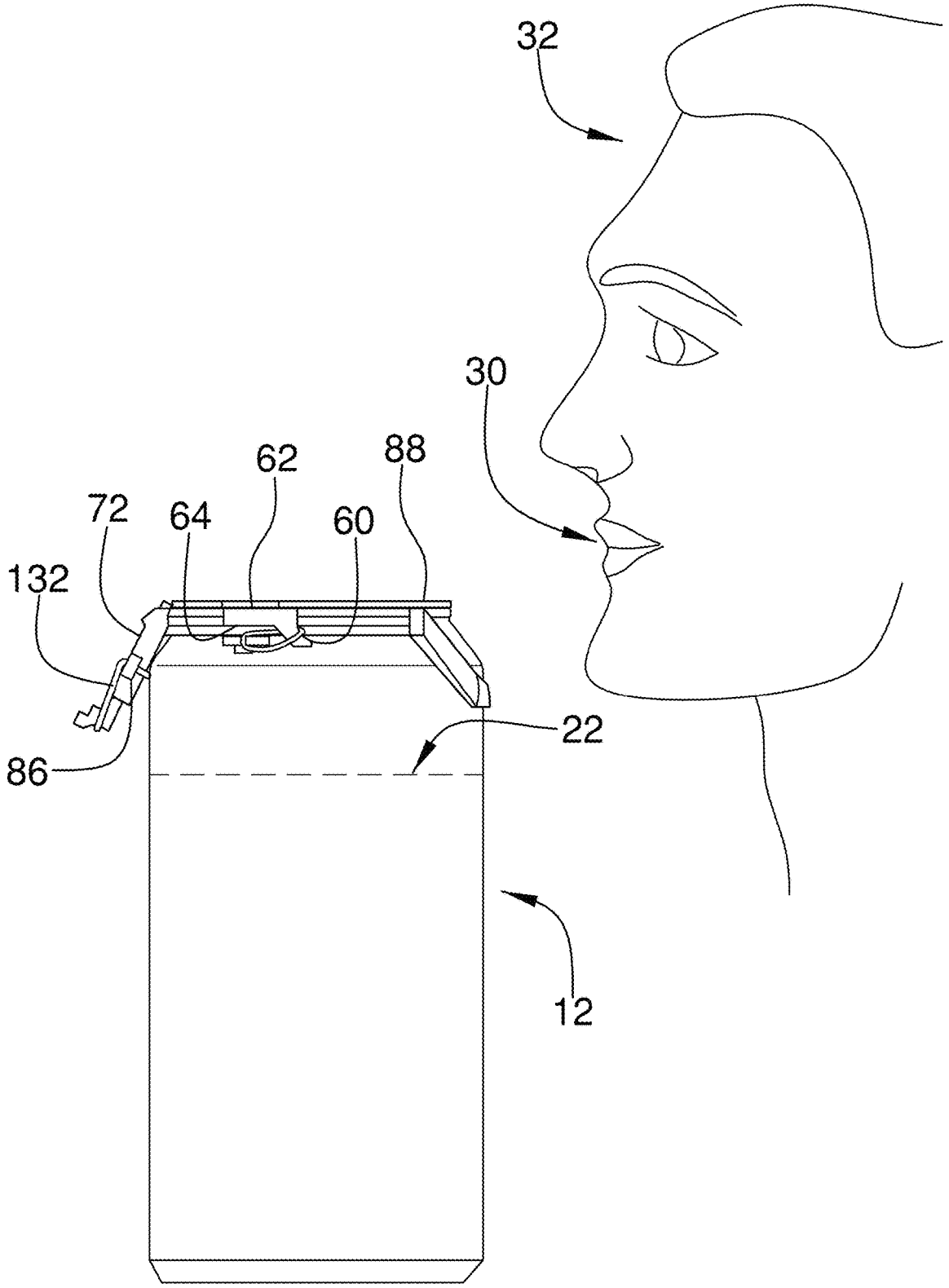
FIG. 7 is a right side in-use view of an embodiment of the disclosure.
Figure 8:
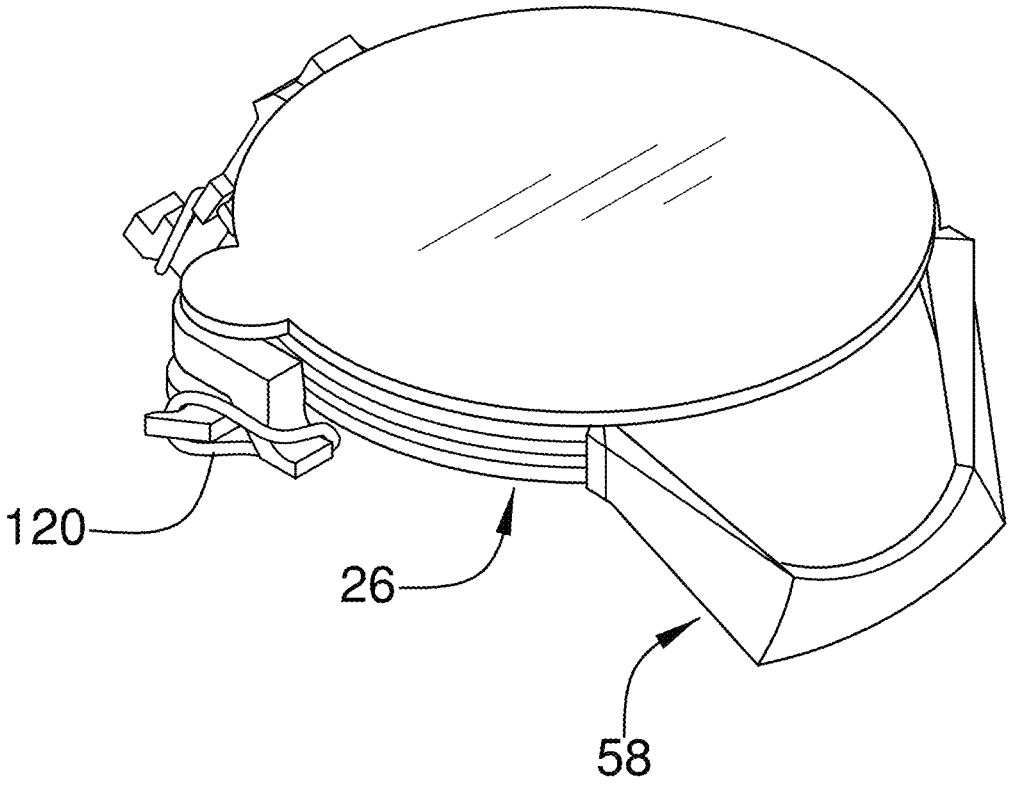
FIG. 8 is a top perspective view of a container mount of an embodiment of the disclosure showing a lid in a closed position.
Figure 9:
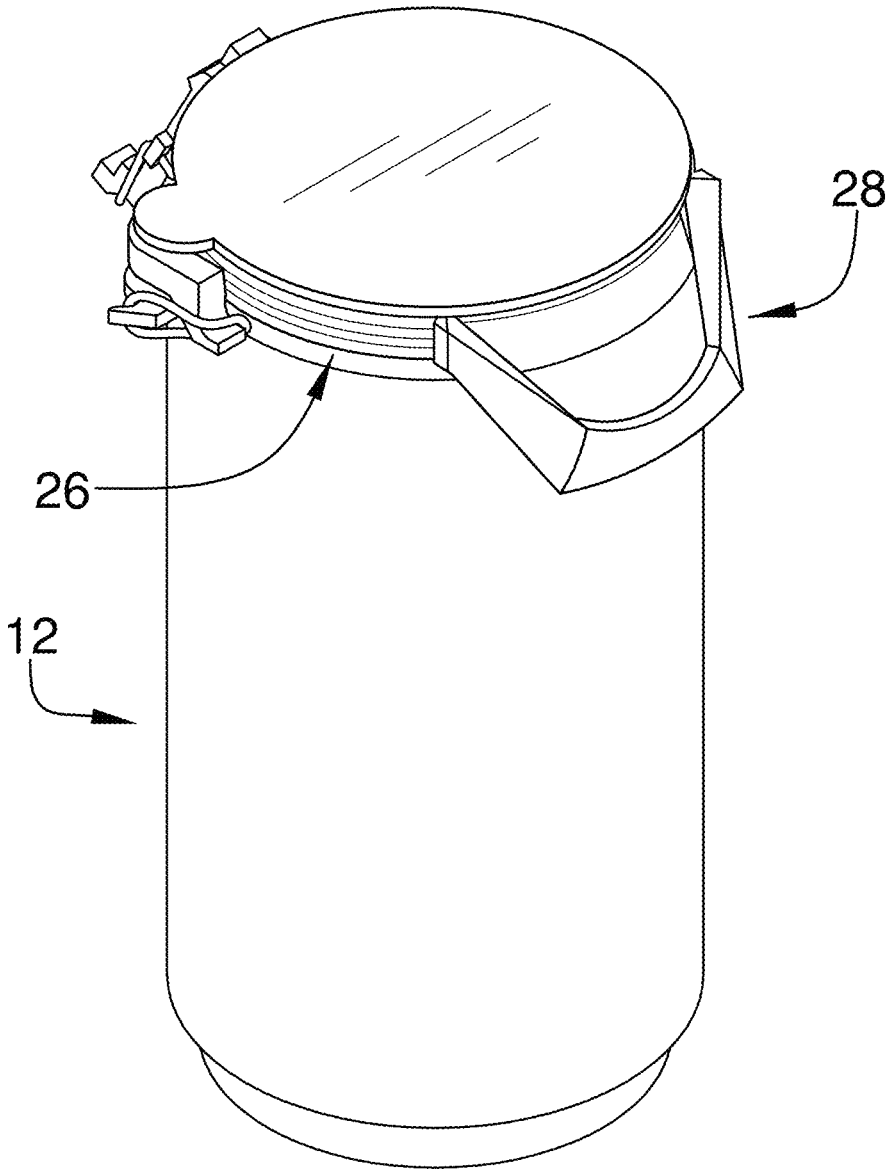
FIG. 9 is a perspective in-use view of an embodiment of the disclosure showing a lid in a closed position.
Figure 10:
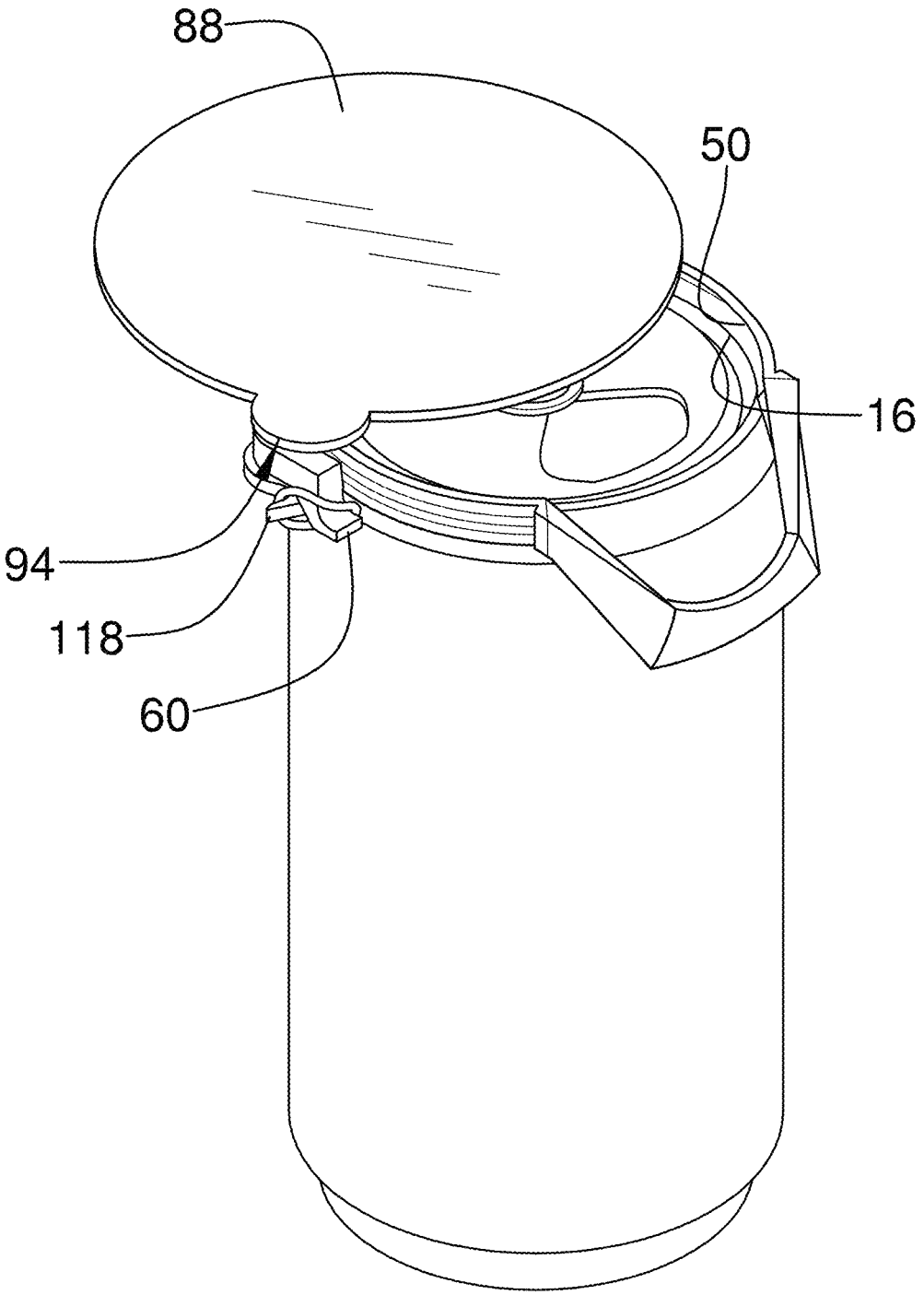
FIG. 10 is a perspective in-use view of an embodiment of the disclosure showing a lid in an open position.

With reference now to the drawings, and in particular to FIGS. 1 through 10 thereof, a new beverage container device embodying the principles and concepts of an embodiment of the disclosure and generally designated by the reference numeral 10 will be described.

As best illustrated in FIGS. 1 through 10, the beverage container lid device 10 generally comprises a beverage container 12 that has a drinking aperture 14 and a rim 16 extending around a full circumference of the beverage container 12. The beverage container 12 has an outer wall 18 and a top wall 20; the outer wall 18 curves inwardly at an intersection between the outer wall 18 and the top wall 20. Furthermore, the rim 16 extends around the intersection between the outer wall 18 and the top wall 20. The drinking aperture 14 extends through the top wall 20 and a beverage 22 which is contained in the beverage container 12 flows through the drinking aperture 14. The beverage container 12 may be an aluminum can, for example, and the beverage 22 contained in the beverage container 12 may be a carbonated and sweetened beverage or other beverage which typically attracts insects to the drinking aperture 14.

A container mount 24 is provided and the container mount 24 is removably attachable to the beverage container 12. The container mount 24 has a ring portion 26 and the ring portion 26 extends around the rim 16 of the beverage container 12 when the container mount 24 is removably attached to the beverage container 12. Additionally, the container mount 24 has a spout portion 28 which angles downwardly from the ring portion 26. The spout portion 28 is aligned with the drinking aperture 14 in the beverage container 12 when the container mount 24 is removably attached to the beverage container 12 to have lips 30 of a user 32 be positioned against the beverage container 12 when the user 32 drinks from the drinking aperture 14.

The ring portion 26 has a first end 34 and a second end 36 and an outer surface 38 extending between the first end 34 and the second end 36. The ring portion 26 is continuously arcuate between the first end 34 and the second end 36 such that the ring portion 26 forms a circular shape such that the ring portion 26 extends around the outer wall 18 of the beverage container 12. The first end 34 is aligned with and is spaced from the second end 36; the outer surface 38 has an inner side 40 and an outer side 42 and the ring portion 26 has a top edge 44 and a bottom edge 46. The outer surface 38 has a slot 48 extending into the outer side 42. Furthermore, the slot 48 extends between the first end 34 and the second end 36 and the slot 48 is centrally located between the top edge 44 and the bottom edge 46.

The outer surface 38 has a lip 50 extending away from the inner side 40. The lip 50 is aligned with the top edge 44 and the lip 50 extends between the first end 34 and the second end 36. The ring portion 26 has an inside diameter which is sufficient to accommodate an outside diameter of the of the intersection between the outer wall 18 of the beverage container 12 and the top wall 20 of the beverage container 12. Furthermore, the lip 50 compresses against the rim 16 on the top wall 20 of the beverage container 12 when the ring portion 26 is positioned around the outer wall 18 of the beverage container 12 for releasably retaining the container mount 24 on the beverage container 12.

The spout portion 28 comprises a medial member 52 which is perpendicularly oriented with a pair of outward members 54. Each outward member 54 of the pair of outward members 54 is coupled to and angles downwardly from a respective one of the first end 34 and the second end 36 of the ring portion 26. The medial member 52 has an upper edge 56 and the upper edge 56 curves downwardly between the pair of outward members 54 to accommodate the lips 30 of the user 32 when the user 32 drinks from the beverage container 12. As is most clearly shown in FIG. 7, the medial member 52 is curved between the pair of outward members 54 such that the medial member 52 conforms to curvature of the outer wall 18 of the beverage container 12 when the container mount 24 is attached to the beverage container 12.

A pivot 58 is coupled to and extends away from the container mount 24 and the pivot 58 has a pivot finger 60 which extends away from the pivot 58. Additionally, the pivot 58 extends laterally away from the outer side 42 of the outer surface 38 of the ring portion 26 of the container mount 24. The pivot 58 has an upper surface 62 and a lower surface 64; the upper surface 62 is aligned with the top edge 44 of the ring portion 26. Additionally, the pivot 58 has a hole 66 extending through the upper surface 62 and the lower surface 64. The pivot finger 60 extends toward the spout portion 28 of the container mount 24 and the pivot finger 60 extends downwardly beyond the lower surface 64 of the pivot 58. Furthermore, the pivot finger 60 has a forward end 68 and a front surface 70 extending between the forward end 68 and the upper surface 62 of the pivot 58. The front surface 70 curves forwardly between the upper surface 62 of the pivot 58 and the forward end 68.

A lock slide 72 is coupled to and angles downwardly from the container mount 24 and the lock slide 72 has a channel 74 extending through the lock slide 72. The lock slide 72 is disposed on the outer side 42 of the outer surface 38 of the ring portion 26 of the container mount 24. The lock slide 72 has a top end 76 and a bottom end 78; the top end 76 is aligned with the top edge 44 of the ring portion 26 and the channel 74 extends through the top end 76 and the bottom end 78. Furthermore, the lock slide 72 angles rearwardly away from the ring portion 26 and the lock slide 72 is positioned opposite the spout portion 28. The lock slide 72 has a first lateral side 80 and a second lateral side 82. The lock slide 72 has a first catch 84 which is coupled to the first lateral side 80 and the lock slide 72 has a second catch 86 which is coupled to the second lateral side 82. Each of the first catch 84 and the second catch 86 is located closer to the bottom end 78 than the top end 76. Additionally, the pivot 58 is positioned between the spout portion 28 and the lock slide 72.

A lid 88 is provided and the lid 88 is pivotally attachable to the container mount 24. The lid 88 is positionable in a closed position having the lid 88 being positioned over the beverage container 12 to inhibit insects from accessing the drinking aperture 14. Conversely, the lid 88 is positionable in an open position having the lid 88 is offset from the beverage container 12 thereby exposing the drinking aperture 14 to have the user 32 drink from the drinking aperture 14. The lid 88 has a perimeter edge 90 and a bottom surface 92 and the lid 88 has a lobe 94 extending laterally away from the perimeter edge 90.

A stop 96 is coupled to and extends downwardly from the bottom surface 92 and the stop 96 is offset from a center of the lid 88. Additionally, the stop 96 has a forward edge 98 and the forward edge 98 is oriented perpendicular to the bottom surface 92. The forward edge 98 abuts against the inner side 40 of the outer surface 38 of the ring portion 26 of the container mount 24 when the lid 88 is pivoted into the open position. Furthermore, the stop 96 restricts the lid 88 from pivoting beyond the ring portion 26. As is most clearly shown in FIG. 10, the lid 88 is partially displaced from the top wall 20 of the beverage container 12 when the lid 88 is in the open position such that the drinking aperture 14 is located between the perimeter edge 90 of the lid 88 and the rim 16 of the beverage container 12.

A pin 100 is coupled to and extends downwardly from the bottom surface 92 of the lid 88 and the pin 100 is located on the lobe 94. The pin 100 has a lower end 101 and an outside surface 102 extending between the bottom surface 92 of the lid 88 and the lower end 101; the outside surface 102 has a planar side 104 and a curved side 106. The planar side 104 extends between the bottom surface 92 of the lid 88 and the lower end 101 and the curved side 106 extends between the bottom surface 92 of the lid 88 and the lower end 101. Furthermore, the curved side 106 curves away from the planar side 104 and the pin 100 extends through the hole 66 in the pivot 58.

A pivot ring 108 is provided which has a pin hole 110 that extends through the pivot ring 108. The pin hole 110 has a bounding edge 112 and the bounding edge 112 has a flat portion 114 and a rounded portion 116. The pin 100 on the lid 88 extends through the pin hole 110. Furthermore, the planar side 104 of the outside surface 102 of the pin 100 abuts the flat portion 114 of the bounding edge 112 such that the pivot ring 108 rotates with the pin 100 when the lid 88 is positioned between the open position and the closed position. The curved side 106 of the outside surface 102 of the pin 100 conforms to the rounded portion 116 of the bounding edge 112.

The pivot ring 108 has a finger 118 which extends laterally away from the pivot ring 108. The finger 118 on the pivot ring 108 is oriented to extend laterally away from the pivot finger 60 on the pivot 58 when the pin 100 extends through the pin hole 110. The finger 118 on the pivot ring 108 travels toward from the pivot finger 60 when the lid 88 is pivoted into the open position. Conversely, the finger 118 on the pivot ring 108 travels away the pivot finger 60 when the lid 88 is pivoted into the closed position. A first rubber band 120 is coupled between the pivot 58 and the pivot ring 108 and the first rubber band 120 biases the lid 88 to pivot 58 into the open position. The first rubber band 120 extends around the pivot finger 60 on the pivot 58 and the finger 118 on the pivot ring 108.

A locking member 122 is provided and the locking member 122 is slidably positioned in the lock slide 72. The locking member 122 is positionable in a locking position having the locking member 122 abutting against the lid 88 when the lid 88 is in the closed position for retaining the lid 88 in the closed position. Conversely, the locking member 122 is slidable into an unlocking position having the locking member 122 being disengaged from the lid 88 such that the lid 88 can be positioned in the open position. The locking member 122 has a lowermost end 124 and an uppermost end 126 and a forward surface 128 extending between the lowermost end 124 and the uppermost end 126. The forward surface 128 has a plurality of steps 130 which are spaced apart from each other and are distributed from the lowermost end 124 toward the uppermost end 126. The user 32 can grip the plurality of steps 130 to pull the locking member 122 downwardly into the unlocking position.

A second rubber band 132 is coupled between the locking member 122 and the lock slide 72; the second rubber band 132 biases the locking member 122 into the locking position. The locking member 122 retains the lid 88 in the closed position when the locking member 122 is biased into the locking position. The first rubber band 120 biases the lid 88 to pivot into the open position when the locking member 122 is urged into the unlocking position. The second rubber band 132 extends around the lock slide 72 and the second rubber band 132 rests against each of the first catch 84 and the second catch 86 to inhibit the second rubber band 132 from sliding downwardly off of the lock slide 72.

The lowermost end 124 of the locking member 122 has a concavely arcuate portion 134 which intersects a lowermost one of the plurality of steps 136. The second rubber band 132 extends across the concavely arcuate portion 134 of the lowermost end 124 of the locking member 122 and the concavely arcuate portion 134 inhibits the second rubber band 132 from sliding off of the lowermost end 124. The second rubber band 132 biases the locking member 122 to travel upwardly in the channel 74 in the lock slide 72. The uppermost end 126 of the locking member 122 abuts against the perimeter edge 90 of the lid 88 when the lid 88 is positioned in the closed position to inhibit the lid 88 from pivoting into the open position. Conversely, the locking member 122 slides downwardly in the channel 74 when the locking member 122 is urged into the unlocking position having the uppermost end 126 being displaced from the perimeter edge 90 of the lid 88.

In use, the ring portion 26 of the container mount 24 is positioned around the beverage container 12 and the lid 88 is pivoted into the closed position to cover the top wall 20 of the beverage container 12. The lid 88 inhibits insects from accessing the drinking aperture 14 when the user 32 is outdoors. The locking member 122 is urged downwardly into the unlocking position and the first rubber band 120 biases the lid 88 to pivot into the open position to expose the drinking aperture 14. The user 32 can subsequently drink from the drinking aperture 14 while the lid 88 is in the open position. The user 32 urges the lid 88 into the closed position until the locking member 122 abuts the perimeter edge 90 of the lid 88 to subsequently retain the lid 88 in the closed position. The ring portion 26 of the container mount 24 is removed from the beverage container 12 when the beverage 22 has been consumed and the beverage container 12 is discarded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A beverage container lid device for covering portion or exposing a drinking aperture in a beverage container, said device comprising:

a beverage container having a drinking aperture and a rim extending around a full circumference of said beverage container;

a container mount being removably attachable to said beverage container, said container mount having a ring portion, said ring portion extending around said rim of said beverage container when said container mount is removably attached to said beverage container, said container mount having a spout portion which angles downwardly from said ring portion, said spout portion being aligned with said drinking aperture in said beverage container when said container mount is removably attached to said beverage container wherein said spout portion is configured to have lips of a user be positioned against said beverage container when the user drinks from said drinking aperture;

a pivot being coupled to and extending away from said container mount;

a lock slide being coupled to and angling downwardly from said container mount, said lock slide having a channel extending through said lock slide;

a lid being pivotally attachable to said container mount, said lid being positionable in a closed position having said lid being positioned over said beverage container wherein said lid is configured to inhibit insects from accessing said drinking aperture, said lid being positionable in an open position having said lid being offset from said beverage container thereby exposing said drinking aperture wherein said lid is configured to have the user drink from said drinking aperture;

a pivot ring;

a pin being coupled to said lid, said pin extending through said pivot and said pivot ring;

a first rubber band being coupled between said pivot and said pivot ring, said first rubber band biasing said lid to pivot into said open position;

a locking member being slidably positioned in said lock slide, said locking member being positionable in a locking position having said locking member abutting against said lid when said lid is in said closed position for retaining said lid in said closed position, said locking member being slidable into an unlocking position having said locking member being disengaged from said lid such that said lid can be positioned in said open position; and a second rubber band being coupled between said locking member and said lock slide, said second rubber band biasing said locking member into said locking position, said locking member retaining said lid in said closed position when said locking member is biased into said locking position, said first rubber band biasing said lid to pivot into said open position when said locking member is urged into said unlocking position, said second rubber band extending around said lock slide.

2. The beverage container lid device according to claim 1, further comprising:

said beverage container having an outer wall and a top wall;

said outer wall curving inwardly at an intersection between said outer wall and said top wall;

said rim extending around said intersection between said outer wall and said top wall; and said drinking aperture extending through said top wall wherein said drinking aperture is configured to have a beverage which is contained in said beverage container flow through said drinking aperture.

3. The beverage container lid device according to claim 2, further comprising:

said ring portion having a first end and a second end and an outer surface extending between said first end and said second end;

said ring portion being continuously arcuate between said first end and said second end such that said ring portion forms a circular shape such that said ring portion extends around said outer wall of said beverage container; and said first end being aligned with and being spaced from said second end.

4. The beverage container lid device according to claim 3, further comprising:

said outer surface having an inner side and an outer side;

said ring portion having a top edge and a bottom edge;

said outer surface having a slot extending into said outer side;

said slot extending between said first end and said second end;

said slot being centrally located between said top edge and said bottom edge.

5. The beverage container lid device according to claim 4, further comprising:

said outer surface having a lip extending away from said inner side;

said lip being aligned with said top edge;

said lip extending between said first end and said second end;

said ring portion having an inside diameter being sufficient to accommodate an outside diameter of said of said intersection between said outer wall of said beverage container and said top wall of said beverage container; and said lip compressing against said rim on said top wall of said beverage container when said ring portion is positioned around said outer wall of said beverage container for releasably retaining said container mount on said beverage container.

6. The beverage container lid device according to claim 3, further comprising:

said spout portion comprising a medial member being perpendicularly oriented with a pair of outward members; and each outward member of said pair of outward member being coupled to and angling downwardly from a respective one of said first end and said second end of said ring portion.

7. The beverage container lid device according to claim 6, further comprising:

said medial member having an upper edge; and said upper edge curving downwardly between said pair of outward members wherein said upper edge is configured to accommodate the lips of the user when the user drinks from said beverage container.

8. The beverage container lid device according to claim 4, further comprising:

said pivot extending laterally away from said outer side of said outer surface of said ring portion of said container mount;

said pivot having an upper surface and a lower surface;

said upper surface being aligned with said top edge of said ring portion;

said pivot having a pivot finger extending away from said pivot;

said pivot having a hole extending through said upper surface and said lower surface;

said pivot finger extending toward said spout portion of said container mount;

said pivot finger extending downwardly beyond said lower surface of said pivot;

said pivot finger having a forward end and a front surface extending between said forward end and said upper surface of said pivot; and said front surface curving forwardly between said upper surface of said pivot and said forward end.

9. The beverage container lid device according to claim 4, further comprising:

said lock slide being disposed on said outer side of said outer surface of said ring portion of said container mount;

said lock slide having a top end and a bottom end;

said top end being aligned with said top edge of said ring portion;

said channel extending through said top end and said bottom end;

said lock slide angling rearwardly away from said ring portion; and said lock slide being positioned opposite said spout portion.

10. The beverage container lid device according to claim 9, further comprising:

said lock slide having a first lateral side and a second lateral side;

said lock slide having a first catch being coupled to said first lateral side;

said lock slide having a second catch being coupled to said second lateral side; and each of said first catch and said second catch being located closer to said bottom end than said top end.

11. The beverage container lid device according to claim 8, further comprising:

said ring portion of said container mount having an outer surface;

said outer surface having an inner side;

said lid having a perimeter edge and a bottom surface;

said lid having a lobe extending laterally away from said perimeter edge;

said pin on said lid being coupled to and extending downwardly from said bottom surface of said lid;

said pin being located on said lobe; and said pin extending through said hole in said pivot.

12. The beverage container lid device according to claim 11, further comprising:

a stop being coupled to and extending downwardly from said bottom surface of said lid;

said stop being offset from a center of said lid;

said stop having a forward edge;

said forward edge being oriented perpendicular to said bottom surface;

said forward edge abutting against said inner side of said outer surface of said ring portion of said container mount when said lid is pivoted into said open position; and said stop restricting said lid from pivoting beyond said ring portion.

13. The beverage container lid device according to claim 11, further comprising:

said pin having a lower end and an outside surface extending between said bottom surface of said lid and said lower end;

said outside surface having a planar side and a curved side;

said planar side extending between said bottom surface of said lid and said lower end;

said curved side extending between said bottom surface of said lid and said lower end; and said curved side curving away from said planar side.

14. The beverage container lid device according to claim 13, further comprising:

said pivot ring having a pin hole extending through said pivot ring;

said pin hole in said pin ring having a bounding edge;

said bounding edge having a flat portion and a rounded portion;

said pin on said lid extending through said pin hole;

said planar side of said outside surface of said pin abutting said flat portion of said bounding edge such that said pivot ring rotates with said pin when said lid is positioned between said open position and said closed position; and said curved side of said outside surface of said pin conforming to said rounded portion of said bounding edge.

15. The beverage container lid device according to claim 14, further comprising:

said pivot ring having a finger of said pivot ring extending laterally away from said pivot ring;

said finger on said pivot ring being oriented to extend laterally away from said pivot finger on said pivot when said pin extends through said pin hole;

said finger on said pivot ring travelling toward from said pivot finger when said lid is pivoted into said open position; and said finger on said pivot ring travelling away said pivot finger when said lid is pivoted into said closed position.

16. The beverage container lid device according to claim 15, further comprising said first rubber band extending around said pivot finger on said pivot and said finger on said pivot ring.

17. The beverage container lid device according to claim 1, further comprising:

said locking member having a lowermost end and an uppermost end and a forward surface extending between said lowermost end and said uppermost end;

said forward surface having a plurality of steps being spaced apart from each other and being distributed from said lowermost end toward said uppermost end wherein said plurality of steps is configured to be gripped by the user to pull said locking member downwardly into said unlocking position; and said lowermost end having a concavely arcuate portion which intersects a lowermost one of said plurality of steps.

18. The beverage container lid device according to claim 17, further comprising:

said locking member having a first catch being coupled to said locking member;

said locking member having a second catch being coupled to said locking member;

said second rubber band resting against each of said first catch and said second catch to inhibit said second rubber band from sliding downwardly off of said lock slide;

said second rubber band extending across said concavely arcuate portion of said lowermost end of said locking member;

said concavely arcuate portion inhibiting said second rubber band from sliding off of said lowermost end of said locking member; and said second rubber band biasing said locking member to travel upwardly in said channel in said lock slide.

19. The beverage container lid device according to claim 18, further comprising:

said lid having a perimeter edge;

said uppermost end of said locking member abutting against said perimeter edge of said lid when said lid is positioned in said closed position to inhibit said lid from pivoting into said open position; and said locking member sliding downwardly in said channel when said locking member is urged into said unlocking position having said uppermost end being displaced from said perimeter edge of said lid.

20. A beverage container lid device for covering portion or exposing a drinking aperture in a beverage container, said device comprising:

a beverage container having a drinking aperture and a rim extending around a full circumference of said beverage container, said beverage container having an outer wall and a top wall, said outer wall curving inwardly at an intersection between said outer wall and said top wall, said rim extending around said intersection between said outer wall and said top wall, said drinking aperture extending through said top wall wherein said drinking aperture is configured to have a beverage which is contained in said beverage container flow through said drinking aperture;

a container mount being removably attachable to said beverage container, said container mount having a ring portion, said ring portion extending around said rim of said beverage container when said container mount is removably attached to said beverage container, said container mount having a spout portion which angles downwardly from said ring portion, said spout portion being aligned with said drinking aperture in said beverage container when said container mount is removably attached to said beverage container wherein said spout portion is configured to have lips of a user be positioned against said beverage container when the user drinks from said drinking aperture, said ring portion having a first end and a second end and an outer surface extending between said first end and said second end, said ring portion being continuously arcuate between said first end and said second end such that said ring portion forms a circular shape such that said ring portion extends around said outer wall of said beverage container, said first end being aligned with and being spaced from said second end, said outer surface having an inner side and an outer side, said ring portion having a top edge and a bottom edge, said outer surface having a slot extending into said outer side, said slot extending between said first end and said second end, said slot being centrally located between said top edge and said bottom edge, said outer surface having a lip extending away from said inner side, said lip being aligned with said top edge, said lip extending between said first end and said second end, said ring portion having an inside diameter being sufficient to accommodate an outside diameter of said of said intersection between said outer wall of said beverage container and said top wall of said beverage container, said lip compressing against said rim on said top wall of said beverage container when said ring portion is positioned around said outer wall of said beverage container for releasably retaining said container mount on said beverage container, said spout portion comprising a medial member being perpendicularly oriented with a pair of outward members, each outward member of said pair of outward member being coupled to and angling downwardly from a respective one of said first end and said second end of said ring portion, said medial member having an upper edge, said upper edge curving downwardly between said pair of outward members wherein said upper edge is configured to accommodate the lips of the user when the user drinks from said beverage container;

a pivot being coupled to and extending away from said container mount, said pivot having a pivot finger extending away from said pivot, said pivot extending laterally away from said outer side of said outer surface of said ring portion of said container mount, said pivot having an upper surface and a lower surface, said upper surface being aligned with said top edge of said ring portion, said pivot having a hole extending through said upper surface and said lower surface, said pivot finger extending toward said spout portion of said container mount, said pivot finger extending downwardly beyond said lower surface of said pivot, said pivot finger having a forward end and a front surface extending between said forward end and said upper surface of said pivot, said front surface curving forwardly between said upper surface of said pivot and said forward end;

a lock slide being coupled to and angling downwardly from said container mount, said lock slide having a channel extending through said lock slide, said lock slide being disposed on said outer side of said outer surface of said ring portion of said container mount, said lock slide having a top end and a bottom end, said top end being aligned with said top edge of said ring portion, said channel extending through said top end and said bottom end, said lock slide angling rearwardly away from said ring portion, said lock slide being positioned opposite said spout portion, said lock slide having a first lateral side and a second lateral side, said lock slide having a first catch being coupled to said first lateral side, said lock slide having a second catch being coupled to said second lateral side, each of said first catch and said second catch being located closer to said bottom end than said top end, said pivot being positioned between said spout portion and said lock slide;

a lid being pivotally attachable to said container mount, said lid being positionable in a closed position having said lid being positioned over said beverage container wherein said lid is configured to inhibit insects from accessing said drinking aperture, said lid being positionable in an open position having said lid being offset from said beverage container thereby exposing said drinking aperture wherein said lid is configured to have the user drink from said drinking aperture, said lid having a perimeter edge and a bottom surface, said lid having a lobe extending laterally away from said perimeter edge;

a stop being coupled to and extending downwardly from said bottom surface, said stop being offset from a center of said lid, said stop having a forward edge, said forward edge being oriented perpendicular to said bottom surface, said forward edge abutting against said inner side of said outer surface of said ring portion of said container mount when said lid is pivoted into said open position, said stop restricting said lid from pivoting beyond said ring portion;

a pin being coupled to and extending downwardly from said bottom surface of said lid, said pin being located on said lobe, said pin having a lower end and an outside surface extending between said bottom surface of said lid and said lower end, said outside surface having a planar side and a curved side, said planar side extending between said bottom surface of said lid and said lower end, said curved side extending between said bottom surface of said lid and said lower end, said curved side curving away from said planar side, said pin extending through said hole in said pivot;

a pivot ring having a pin hole extending through said pivot ring, said pin hole having a bounding edge, said bounding edge having a flat portion and a rounded portion, said pin on said lid extending through said pin hole, said planar side of said outside surface of said pin abutting said flat portion of said bounding edge such that said pivot ring rotates with said pin when said lid is positioned between said open position and said closed position, said curved side of said outside surface of said pin conforming to said rounded portion of said bounding edge, said pivot ring having a finger extending laterally away from said pivot ring, said finger on said pivot ring being oriented to extend laterally away from said pivot finger on said pivot when said pin extends through said pin hole, said finger on said pivot ring travelling toward from said pivot finger when said lid is pivoted into said open position, said finger on said pivot ring travelling away said pivot finger when said lid is pivoted into said closed position;

a first rubber band being coupled between said pivot and said pivot ring, said first rubber band biasing said lid to pivot into said open position, said first rubber band extending around said pivot finger on said pivot and said finger on said pivot ring;

a locking member being slidably positioned in said lock slide, said locking member being positionable in a locking position having said locking member abutting against said lid when said lid is in said closed position for retaining said lid in said closed position, said locking member being slidable into an unlocking position having said locking member being disengaged from said lid such that said lid can be positioned in said open position, said locking member having a lowermost end and an uppermost end and a forward surface extending between said lowermost end and said uppermost end, said forward surface having a plurality of steps being spaced apart from each other and being distributed from said lowermost end toward said uppermost end wherein said plurality of steps is configured to be gripped by the user to pull said locking member downwardly into said unlocking position; and a second rubber band being coupled between said locking member and said lock slide, said second rubber band biasing said locking member into said locking position, said locking member retaining said lid in said closed position when said locking member is biased into said locking position, said first rubber band biasing said lid to pivot into said open position when said locking member is urged into said unlocking position, said second rubber band extending around said lock slide, said second rubber band resting against each of said first catch and said second catch to inhibit said second rubber band from sliding downwardly off of said lock slide, said lowermost end of said locking member having a concavely arcuate portion which intersects a lowermost one of said plurality of steps, said second rubber band extending across said concavely arcuate portion of said lowermost end of said locking member, said concavely arcuate portion inhibiting said second rubber band from sliding off of said lowermost end, said second rubber band biasing said locking member to travel upwardly in said channel in said lock slide, said uppermost end of said locking member abutting against said perimeter edge of said lid when said lid is positioned in said closed position to inhibit said lid from pivoting into said open position, said locking member sliding downwardly in said channel when said locking member is urged into said unlocking position having said uppermost end being displaced from said perimeter edge of said lid.

* * * * *